United States Patent [19]

Kawai et al.

[11] 3,940,271

[45] Feb. 24, 1976

[54] COLOR PHOTOGRAPHIC LIGHT-SENSITIVE MATERIAL

[75] Inventors: Masayoshi Kawai; Tadao Shishido; Shoji Ishiguro; Tadao Sakai, all of Kanagawa, Japan

[73] Assignee: Fuji Photo Film Co., Ltd., Minami-ashigara, Japan

[22] Filed: Feb. 4, 1974

[21] Appl. No.: 439,675

[30] Foreign Application Priority Data

Feb. 2, 1973 Japan ..... 48-13514

[52] U.S. Cl. ..... 96/4; 96/55; 96/60 R; 96/60 BF; 96/74

[51] Int. Cl.[2] .. G03C 7/24; G03C 7/00; G03C 5/32; G03C 1/76

[58] Field of Search ..... 96/66.3, 64, 4, 74, 39, 96/60 R, 55

[56] References Cited

UNITED STATES PATENTS

| | | | |
|---|---|---|---|
| 3,046,130 | 7/1962 | Dersch et al. | 96/66.3 |
| 3,084,044 | 4/1963 | Dersch et al. | 96/66.3 |
| 3,705,799 | 12/1972 | Bello et al. | 96/4 |
| 3,723,125 | 3/1973 | Hayashi et al. | 96/74 X |

*Primary Examiner*—Charles L. Bowers, Jr.
*Assistant Examiner*—Alfonso T. Suro Pico
*Attorney, Agent, or Firm*—Sughrue, Rothwell, Mion, Zinn & Macpeak

[57] ABSTRACT

A color photographic light-sensitive material comprising a support having coated thereon at least one light-sensitive silver halide emulsion layer containing a yellow dye-forming coupler, at least one light-sensitive silver halide emulsion layer containing a magenta dye-forming coupler, at least one light-sensitive silver halide emulsion layer containing a cyan dye-forming coupler, and at least one light-sensitive silver halide emulsion layer containing a compound having a thioether bond directly connected to a nitrogen-containing heterocyclic ring.

13 Claims, No Drawings

COLOR PHOTOGRAPHIC LIGHT-SENSITIVE MATERIAL

BACKGROUND OF THE INVENTION

1. FIELD OF THE INVENTION

The present invention relates to a color photographic light-sensitive material, and more particularly it relates to a color photographic light-sensitive material capable of recording sound images.

2. DESCRIPTION OF THE PRIOR ART

As recording methods for sound images for color photographic light-sensitive materials, an optical recording system and a magnetic recording system are generally known. The present invention relates to the photographic materials suitable for the optical recording system.

Color print films, color reversal films, color reversal print films, etc. are used as the color photographic light-sensitive materials for movies and for television. Sound images are optically recorded with color images on the color photographic light-sensitive materials, and are reproduced by converting the sound signals recorded as the optical density or areas in the materials into light-signals, then converting the light-signals into electric signals using a light-receiving device, and further converting the electric signals into sound signals. In the reproduction steps of sound images, phototubes having various optical characteristics have been used as the light-receiving device. The most typical phototube which is called an "S-1 type" has an optical absorption maximum at about 800$\mu$ in the infra-red region (for example, as disclosed in Adrin Cornwell, *Color Cinematography*, page 593 (1951)).

On the contrary, color dyes, which are formed by the coupling reaction of color couplers and the oxidation products of color developing agents, such as the p-phenylenediamines, according to the subtractive color photography, all have a main absorption within the visible region, and therefore the main absorption of the dyes does not correspond to the optical characteristics of the above-described phototube. Accordingly, sound reproductions based on only color dye images are weak and impractical. For the purpose of more practical sound reproductions of color photographic light-sensitive materials, silver images or silver sulfide images are formed on the sound track areas of the color photographic light-sensitive materials in the developing process, and the optical density in the infra-red region of the images is utilized for sound reproductions. In this case, the optical density in the infra-red region (transmitting density) is usually about 1.0 to 1.6.

The sound track areas of color print films can be produced using the processing steps disclosed in the *Journal of the Society of Motion Picture and Television Engineers*, Vol. 77, page 1154 (1968). According to this method, color images of image portions and sound images of sound track areas are simultaneously developed in a color developing bath. In a first fixing bath, the unexposed silver halide is removed and in a bleaching bath, the developed silver formed in the developing step is rehalogenated. In a sound developing step, the silver halide corresponding to only the sound track areas is converted into silver images by coating a viscous sound developer on the sound track areas, selectively. In a second fixing bath, the silver halide in the image portions is removed, and in a stabilizing bath, the dye image are stabilized. Thus, the optical density in the infra-red region of the silver images on the sound track areas can be utilized for sound reproductions.

As described above, it is necessary in the production of the sound track areas of color films to form silver or silver sulfide images using processing steps other than the color image forming steps. The reason why the sound track areas containing silver or silver sulfide images is needed is due to the optical characteristics of the phototube used for the sound reproductions which requires an absorption maximum in the infra-red region and that the color dyes formed by color development do not have sufficient optical density in this region.

Color photographic light-sensitive materials capable of forming sound track areas which do not require the special processing steps as described above have been proposed (U.S. Pat. Nos. 3,705,801; 3,715,208; and 3,737,312; and U.S. patent application Ser. No. 360,507, filed May 15, 1973). The color photographic light-sensitive materials include an auxiliary layer capable of forming silver images upon color development and which are not bleached in a bleaching step. In the auxiliary layer, developable silver is hardly formed by imagewise exposure, but only in the sound track areas of the layer, silver for sound images is formed which is not bleached in the following bleaching step and hence remains in the layer. Therefore, photographic materials including the auxiliary layer have the advantage that the selective coating of a viscous sound developer on the sound track areas can be omitted. Further, with these photographic materials, since the silver images formed in the sound track areas by color development can be used as the sound images, the rehalogenation step of the developed silver is unnecessary, and the bleaching and fixing step can be carried out in the same bath, whereby the processing steps are simplified.

A color photographic light-sensitive material is composed of a support having coated thereon silver halide emulsion layers having different optical sensitivities. The photographic material is developed, after imagewise exposure, with a color developer, whereby color dye images and silver images are formed. Then, the material is bleached in a bleaching step, whereby the silver images are oxidized, and is fixed in a fixing step, whereby the silver halide is removed and a color photograph containing the color dye images can be obtained.

The above described color photographic light-sensitive material has a layer capable of forming silver images which are not removed by the bleaching and fixing steps, and gives, by conventional color development, a color photograph containing color dye images and silver images that are advantageously utilized as sound track areas.

As an advantageous method for forming the silver images which are not removed by the processing steps, the following compounds are proposed. That is, when the compound is incorporated into a silver halide emulsion layer, it remarkably reduces the rate at which silver is removed in the bleaching and fixing steps or it causes the silver to lose its ability to be removed in these steps. The compound can have the property in which the silver is removed in some degree only in the initial period of these steps but that the silver is not substantially removed after the initial period. Such a compound is defined as a bleach inhibitor in the specification.

As bleach inhibitors, a compound having a mercapto group is disclosed in Japanese Patent Application laid open to public inspection No. 13482/72. However, since a bleach inhibitor is also considered to be a development inhibitor or a chemical inhibitor, it is difficult to obtain a higher optical density of silver even if it is used. Namely, where a large amount of the bleach inhibitor is used, the amount of silver remaining after the bleaching step is small because the amount of the developed silver is small due to the development inhibitor while the bleach inhibiting effect is higher. On the other hand, where a small amount of the bleach inhibitor is used, the amount of silver remaining after the bleaching step is also small because the bleach inhibiting effect is lower while the amount of the developed silver is greater due to less development inhibition.

An object of the invention is, therefore, to provide a bleach inhibitor capable of providing sufficient optical density in the infra-red region without or with little development or chemical inhibition.

Another object of the invention is to provide a color photographic light-sensitive material capable of providing sufficient optical density in the infra-red region which does not require special processing steps as in the conventional method to produce sound track areas by using a novel bleach inhibitor.

Still another object of the invention is to provide a method for forming sound images having higher sound quality which does not involve special processing steps as in the conventional method.

SUMMARY OF THE INVENTION

The above objects of the invention can be attained by using as a bleach inhibitor a compound having a thioether directly connected to a nitrogen-containing heterocyclic ring. That is, according to the present invention, a color photographic light-sensitive material can be provided comprising a support having coated thereon at least one light-sensitive silver halide emulsion layer containing a yellow color-forming coupler, at least one light-sensitive silver halide emulsion layer containing a magenta color-forming coupler, at least one light-sensitive silver halide emulsion layer containing a cyan color-forming coupler and at least one light-sensitive silver halide emulsion layer containing a compound having a thioether directly connected to a nitrogen-containing heterocyclic ring.

DETAILED DESCRIPTION OF THE INVENTION

According to one embodiment of the invention, a light-sensitive material comprises a support having coated thereon a first silver halide emulsion layer containing a coupler forming a yellow dye when reacted with the oxidation product of a color developing agent and having a light-sensitivity in a first region of visible light, a second silver halide emulsion layer containing a coupler forming a magenta dye when reacted with the oxidation product of a color developing agent and having a light-sensitivity in a second region of visible light, a third silver halide emulsion layer containing a coupler forming a cyan dye when reacted with the oxidation product of a color developing agent and having a light-sensitivity in a third region of visible light, and a fourth silver halide emulsion layer containing a bleach inhibitor and having a light-sensitivity in the ultra violet region, visible region or infra-red region.

When the color photographic light-sensitive material is imagewise exposed through an original, and then developed with a color developer, yellow dye images and silver images are formed in the first silver halide emulsion layer, magenta dye images and silver images are formed in the second silver halide emulsion layer, cyan dye images and silver images are formed in the third silver halide emulsion layer, and silver images are formed in the fourth silver halide emulsion layer. Then, the color photographic material is bleached, whereby the silver images in the first, second and third silver halide emulsion layers are bleached but the silver images in the fourth silver halide emulsion layer are not bleached due to the action of the bleach inhibitor and remain. Thus, a color photograph having color dye images and silver sound images is obtained.

The fourth silver halide emulsion layer can have a light-sensitivity to the ultra violet region, the visible region or the infra-red region. However, this silver halide emulsion layer must not form developable silver which gives an optical density in such a degree that the silver adversely influences the color reproduction under usual imagewise exposure. Accordingly, if the light-sensitive region of the fourth silver halide emulsion layer overlaps those of the first, second and third silver halide emulsion layers, it is desirable that the sensitivity of the fourth silver halide emulsion layer be ¼ or less, preferably 1/6 or less, the sensitivities of the other layers.

Alternatively, the sensitivity region of the fourth silver halide emulsion layer can be provided between the sensitivity regions of the first and second silver halide emulsion layers and/or between the sensitivities of the second and third silver halide emulsion layers. These methods, i.e., this method and that described above, can be used in combination. By applying these methods the formation of a silver image in the fourth silver halide emulsion layer in an amount undesirable for color photographic images can be prevented.

In the light-sensitive material of the invention, a silver halide emulsion layer containing a bleach inhibitor is further coated in addition to a blue-sensitive emulsion layer, a green-sensitive emulsion layer and a red-sensitive emulsion layer of the conventional color photographic light-sensitive material.

As a preferred embodiment of the invention, the photographic material comprises a support having coated thereon, in order from the support, a blue-sensitive silver halide emulsion layer containing a yellow dye-forming coupler, a red-sensitive silver halide emulsion layer containing a cyan dye-forming coupler, a green-sensitive silver halide emulsion layer containing a magenta dye-forming coupler and a green-sensitive silver halide emulsion layer containing a bleach inhibitor.

In this case, two green-sensitive silver halide emulsion layers, i.e., the green-sensitive layer containing the magenta dye-forming coupler and the green-sensitive layer containing the bleach inhibitor, can be coated in the reverse order. In all cases, the emulsion layer containing the bleach inhibitor can have an optical sensitivity in the ultra violet region, the visible region or the infra-red region.

As another preferred embodiment of the invention, the silver halide emulsion layers containing the dye-forming couplers can be coated on a support in an order different from the above embodiment, for example, in the order on a support of a blue-sensitive layer containing a yellow dye-forming coupler, a green-sensitive layer containing a bleach inhibitor, a red-sensitive layer containing a cyan dye-forming coupler and a green-sensitive layer containing a magenta dye-forming coupler or in the order on a support of a green-sensitive layer containing a bleach inhibitor, a blue-sensitive layer containing a yellow dye-forming coupler, a red-sensitive layer containing a cyan dye-forming coupler and a green-sensitive layer containing a magenta dye-forming coupler.

A bleach inhibitor represented by the following general formula (I) is quite advantageous in this invention and is preferred,

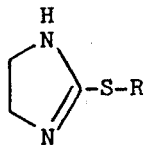

wherein R is an alkyl group having not less than 12 carbon atoms, with the alkyl group being both substituted or unsubstituted. Generally, an alkyl group having up to 20 carbon atoms can suitably be used. Suitable examples of such alkyl groups are dodecyl, tetradecyl, pentadecyl, hexadecyl, oleyl, octadecyl, etc. groups. Suitable substituents which can be present are alkoxy groups such as methoxy, ethoxy, etc., hydroxy, sulfo, carboxy, amino, etc.

An alkylimidazole compound represented by the general formula (I) can be in the free form or in a salt form. The salt can be formed using usual salt-forming agents such as hydrogen halides, perchloric acid, sulfuric acid, nitric acid, etc.

The following compounds are typical examples of compounds of the general formula (I).

(1) 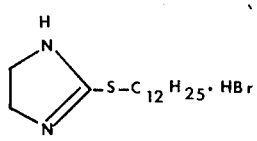 (melting point, m.p. 81°C)

(2) 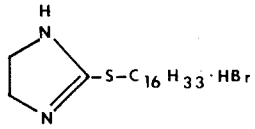 (m.p. 96°C)

(3) 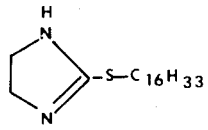 (m.p. 91°C)

(4) 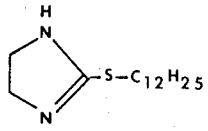 (m.p. 87°C)

(5) 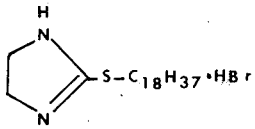 (m.p. 96°C)

These compounds can be easily synthesized by the reaction of ethylene thiourea and an alkyl halide as described in *Analytical Chemistry*, vol. 32, page 55 (1966).

Since the compound represented by the general formula (I) is non-diffusible, per se, and does not diffuse into color image-forming layers, silver images do not remain in the color image-forming layers.

The bleach inhibitor having thioether bond of the invention is different from the mercapto compound described in U.S. Pat. No. 3,715,208 in into chemical structure and its properties. That is, while the mercapto compound forms a mercapto silver salt in the presence of silver ion, the bleach inhibitor of the invention does not form mercapto silver salt under the same conditions. This is proved from the results of argentometric (potential) titration which is carried out using the bleach inhibitors (1) and (3) of the invention, and the compund (A) having a mercapto group.

Compound (A) $HS-C_{12}H_{25}$

The silver potential is measured by dissolving $1 \times 10^{-3}$ mol of each compound in methanol, adding a buffer to each solution to adjust the pH to 5.0, 7.0, 9.0 and 11.0, and then adding dropwise an aqueous silver nitrate solution at the rate of one equivalent per 5 minutes at 50°C. The buffer each is an acetate buffer for the pH of 5.0, a maleate buffer for the pH of 7.0, and and a borate buffer for the pH of 9.0 and pH 11.0. The results obtained are shown in the following table.

| pH | Buffer Only | Bleach Inhibitor (1) | | Bleach Inhibitor (3) | Compound (A) | |
|---|---|---|---|---|---|---|
| | (Volts) | 1 Equivalent | 2 Equivalent | 1 Equivalent | 1 Equivalent | 2 Equivalent |
| | | (Volts) | (Volts) | (Volts) | (Volts) | (Volts |
| 5.0 | + 0.54 | + 0.28 | + 0.55 | + 0.54 | + 0.04 | + 0.55 |
| 7.0 | + 0.52 | " | + 0.51 | + 0.52 | − 0.04 | + 0.52 |
| 9.0 | + 0.53 | " | + 0.52 | + 0.53 | − 0.08 | + 0.51 |
| 11.0 | + 0.40 | " | + 0.41 | + 0.39 | − 0.13 | + 0.41 |

In the table, since silver potential (+0.28 volt) of the bleach inhibitor (1) to one equivalent of silver has no relation to the pH value and the silver potential of the bleach inhibitor (3) to two equivalents of silver is not shown, it is believed that these silver potentials depend on the silver potential of silver bromide. Also, it is believed that all silver potentials of the bleach inhibitor (1) to two equivalents of silver, the bleach inhibitor (3) to one equivalent of silver and the compound (A) to two equivalents of silver depend on the silver potential of the buffer. Further, it is believed that the silver potential of + 0.04 volt, − 0.04 volt, − 0.08 volt and − 0.13 volt at pH 5.0, pH 7.0, pH 9.0 and pH 11.0 of the compound (A) each depends on the silver potential of the mercapto silver. From the results that the bleach inhibitors (1) and (3) do not show reducing values, it is apparent that they can not form mercapto silver at a pH of 5.0 to 11.0.

The bleach inhibitor of the invention does not have a mercapto group in the structure and does not produce the mercapto group during the preparation of the photographic material and during the photographic processings thereof.

The bleach inhibitor of the invention has the following advantage in comparison with a compound having a mercapto group. That is, the mercapto compound is strongly adsorbed on the silver particles, whereby the bleaching of silver is reduced. However, since the mercapto compound is adsorbed on silver halide particles, similarly, the optical density of the developed silver, as a result thereof, is reduced. It is, therefore, impossible to obtain a sufficient optical density in the infra-red region and to obtain higher sound quality. On the contrary, the bleach inhibitor of the invention is not adsorbed on silver halide particles but is selectively adsorbed on only silver particles, whereby the silver particles are protected from bleaching. Accordingly, the optical density of the silver is not reduced as in the case of using a mercapto compound and a stronger bleach inhibiting action is obtained. Thus, a higher optical density in the infra-red region and higher a sound quality can be obtained.

The amount of the bleach inhibitor which can be added to the light-sensitive material of this invention, although it will differ depending on the characteristics of the inhibitor and emulsions used, is usually about $1 \times 10^{-7}$ to $1 \times 10^{5}$g, preferably about $1 \times 10^{-5}$ to $1 \times 10^{4}$g, per 1 mol of silver in the emulsion layer to which it is added.

Examples of the preferable supports on which the lightsensitive silver halide emulsion layers are coated are a cellulose ester film such as a cellulose nitrate film or a cellulose acetate film; a polyester film such as a polyethylene terephthalate film; a polyvinyl chloride film; a polystyrene film; a polycarbonate film, etc.

The hydrophilic colloid which can be used in the silver halide emulsion layer includes all of those known in the art. Advantageously gelatin, acylated gelatin such as described in U.S. Pat. No. 2,614,928, glaft gelatin such as described in U.S. Pat. Nos. 2,831,767; 2,763,625; and 2,956,884, albumin, gum arabic, agar, a cellulose derivative (e.g., an alkyl ester of carboxycellulose, hydroxyethyl cellulose, carboxymethyl hydroxyethyl cellulose), and a synthetic resin (e.g., polyvinyl alcohol, polyvinyl pyrrolidone) can be used. These hydrophilic colloids also can be preferably used as a binder for a photographic layer other than the emulsion layer, such as a protective or uppermost layer, a filter layer, an intermediate layer, an antihalation layer, a subbing layer or a backing layer.

The hydrophilic colloid used for the photographic layers of the light-sensitive material can be advantageously hardened using hardeners such as aldehydes, methylols, 1,4-dioxanes, azirizines, isooxazoles, carbodiimides, active halogen compounds or active vinyl compounds, for example, as described in U.S. Pat. Nos. 3,232,764; 3,288,775; 2,732,303; 3,635,718; 3,232,763; 2,732,316; 2,586,168; 3,103,437; 3,017,280; 2,983,611; 2,725,294; 2,725,295; 3,100,704; 2,091,537; 3,321,313, etc.

In the light-sensitive materials of the invention, all silver halide emulsions known in the photographic art can be used. As such silver halides, there are silver bromide, silver iodobromide, silver chlorobromide, silver chloroiodobromide, silver chloride, etc. A so-called converted type silver halide particles disclosed in U.S. Pat. Nos. 2,592,250 and 3,622,318 and British Pat. No. 635,841 can also be advantageously used.

The silver halide emulsion can be chemically sensitized using active gelatin or with a sulfur compound. It can be also chemically sensitized with a noble metal salt such as palladium or gold, a reducing agent such as a stannous salt or a polyalkylene derivative as described in U.S. Pat. Nos. 1,574,944; 1,623,499; 2,410,689; 2,448,060; 2,399,083; 2,642,361; and 2,487,850. The emulsion can be further spectrally sensitized with a cyanine or merocyanine dye as described in U.S. Pat. Nos. 2,519,001; 2,666,761; 2,734,900; 2,739,964; and 3,481,742. The emulsion can contain a stabilizer such as a mercury compound or an azaindene, a plasticizer such as glycerol as described in C. E. K. Mees and T. H. James, *The Theory of the Photographic Process*, pages 53 – 54, The Macmillan Co., New York (1966) and in U.S. Pat. Nos. 2,904,434; 2,940,854, etc., or a coating aid such as saponin or polyethylene glycol monolaurylether as described in U.S. Pat. Nos. 3,663,229; 3,619,199; 3,617,292; 3,545,974; 3,607,291; 3,589,906; 3,539,152; 3,564,576; 3,514,253; 3,666,478; 3,506,449; 3,514,293; and 3,493,379. Further, it can contain an antistatic agent as described in U.S. Pat. No. 2,739,888, an ultraviolet absorbent as described in U.S. Pat. Nos. 2,415,624; 3,052,636; 3,074,971; 3,085,097; 3,069,456; 3,215,536; 2,719,086; 2,537,877; 2,739,888; 2,784,087; 2,882,150; 2,875,053; 2,739,971; 3,097,100; 3,060,029; 2,632,701; 2,888,346; and 2,748,021, an optical brightening agent as described in U.S. Pat. Nos. 3,630,738; 3,615,544; 3,586,673 and 3,434,837 and British Pat. Nos. 1,332,475; 1,319,763; and 1,333,586, etc.

In the present invention, all kinds of open-chain ketomethylene type yellow dye-forming couplers can be advantageously used. Typical examples of these couplers include benzoyl acetoanilide type couplers and pivaloyl acetoanilide type couplers. All kinds of magenta dye-forming couplers such as pyrazolones or indazolones also can be advantageously used. Further, all kinds of cyan dye-forming couplers such as the phenols or naphthols can be advantageously used. These couplers can have a coupling-off group connected to the active carbon atoms at the coupling position. In these couplers, it is preferable that they have a ballast group in the molecule, whereby they are rendered non-diffusible. The terms "coupling-off group", "ballast group" and "non-diffusible" are used as they are generally used in the art with respect to color couplers, and can be easily understood by one skilled in the art. More preferable color couplers in the invention are selected from the group consisting of yellow dye-forming couplers which react with the oxidation product of a color developing agent to form yellow dyes having an absorption maximum between 420 to 460 $\mu$, magenta dye-forming couplers which react with the oxidation product of a color developing agent to form magenta dyes having an absorption maximum between 520 to 570 $\mu$, and cyan dye-forming couplers which react with the oxidation product of a color developing agent to form cyan dyes having an absorption maximum between 630 to 710 $\mu$. Suitable examples of such couplers are well known in the art, for example, as disclosed in U.S. Pat. Nos. 1,108,028; 2,186,849; 2,206,142; 2,343,702; 2,367,531; 2,369,489; 2,423,730; 2,436,130; 2,474,293; 2,600,788; 2,689,793; 2,728,658; 2,742,832; 2,808,329; 2,998,314; 3,046,129; 3,062,653; 3,265,506; 3,311,476; 3,408,194; 3,419,390; 3,419,391; 3,458,315; 3,476,563; 3,516,831, etc.

These couplers are introduced into the hydrophilic colloid of photographic material using well-known techniques. For example, the couplers can be dissolved in a high boiling organic solvent such as dibutyl phthalate or tricresyl phosphate as described in U.S. Pat. No. 2,322,027, if necessary, in a mixture of the solvent with a low boiling organic solvent, and the resulting solution is dispersed in the hydrophilic colloid. If the couplers have an acid group such as a carboxylic acid or sulfonic acid group, they can be introduced into the hydrophilic colloid as an aqueous alkaline solution.

To the color photographic light-sensitive material of the invention, there can be also used the "infra-red couplers" described in U.S. Pat. Nos. 2,530,349 and 2,545,687. The "infrared couplers" are couplers capable of forming dyes having a longer wave length than 725 $\mu$ by a coupling reaction with the oxidation product of a color developing agent By utilizing the optical density of these dyes, the optical density of the silver images in sound track areas can be decreased. That is, the amount of silver coated can be further reduced.

The color photographic light-sensitive materials of the invention is imagewise and sound-imagewise exposed in a conventional manner, and then is processed using conventional color developing steps, which are basically color development, bleach and fixing steps, and if necessary, include a washing step therebetween. After the fixing step, the photographic material is washed and dried, but it is preferred that it be treated with a stabilizing bath before the drying step.

A useful color developer is an aqueous alkaline solution containing a color developing agent. Examples of color developing agents include the well-known primary aromatic amine dye-forming developing agents, for example, the phenylenediamines (e.g., N,N-diethyl-p-phenylenediamine, N-ethyl-N-hydroxyethyl-p-phenylenediamine, N-ethyl-N-hydroxyethyl-2-methyl-p-phenylenediamine, N-ethyl-$\beta$-N-methanesulfonamidoethyl-3-methyl-4-aminoaniline, N,N-diethyl-2-methyl-p-phenylenediamine, and the sulfates thereof, the hydrochlorides thereof and the sulfites thereof). The color developer can further contain conventional additives such as alkali metal sulfites, carbonates, bisulfites, bromides, iodides or benzyl alcohol. These developing solutions and their components are well known and are described, for example, in C. E. K. Mees and T. H. James, *The Theory of the Photographic Process*, pages 294 – 295, The Macmillan Co., New York, (1966) and in U.S. Pat. Nos. 2,592,364; 2,193,015, etc.

A bleach solution is one which contains conventional bleaching (oxidizing) agents such as ferricyanide or bichromate, and a fixing solution is one which contains conventional fixing agents such as sodium thiosulfate or potassium thiocyanate. The bleach step and the fixing step can be carried out in one bath in the invention, which is impossible in the conventional method requiring sound development. By using such a bleach-fix bath, the processing steps are even more simplified and the processing time is shortened.

The bleach-fix solution in the invention can contain a silver halide solvent which has been used in conventional bleach-fix solutions, such as a water soluble thiosulfate (sodium thiosulfate, potassium thiosulfate, ammonium thiosulfate, etc.), a water soluble thiocyanide (sodium thiocyanide, potassium thiocyanide, ammonium thiocyanide, etc.), a water soluble organic diol fixing agent having an oxygen atom or a sulfur atom (3thia-1,5-pentanediol, 3,6-dithia-1,8-octanediol, 9-oxa-3,6,12,15-tetrathia-1,17-heptadecanediol, etc.), a water soluble sulfurcontaining organic dibasic acid and a water soluble salt (ethylene bisthioglycolic acid, the sodium salt thereof, etc.).

The bleach-fix solution in the invention can contain an oxidizing agent for silver which has been used in conventional bleach-fix solutions, such as a water soluble ferricyanide (e.g., sodium ferricyanide, potassium ferricyanide, ammonium ferricyanide, etc.), a water soluble quinone (e.g., quinone, chloroquinone, methylquinone, etc.), a water soluble ferric salt (e.g., ferric chloride, ferric sulfate, ferric thiocyanide, ferric oxalate, etc.), a water soluble cupric salt (e.g., cupric chloride, cupric nitrate, etc.), a water soluble cobaltic salt (e.g., cobaltic chloride, ammonium cobaltic nitrate, etc.). As the oxidizing agent, a polyvalent cation of a water soluble organic acid and an alkali metal complex thereof are preferably used. The organic acid includes compounds represented by the general formulae, $$HOOC-R_1-X-R_2-COOH$$

or $$\begin{array}{l} HOOC-R_3-N-R_4-COOH \\ \qquad\qquad\;\; | \\ \qquad\qquad\;\; R_5 \\ \qquad\qquad\;\; | \\ HOOC-R_3-N-R_4-COOH \end{array}$$

wherein X is a hydrocarbon group, a oxygen atom, a sulfur atom or a $NR_6$ group, $R_1$, $R_2$, $R_3$, $R_4$ and $R_5$ each is an unsubstituted or a substituted hydrocarbon group, and $R_6$ is a hydrogen atom or an unsubstituted or substituted hydrocarbon group.

Examples of these organic acids are malonic acid, tartaric acid, ethyl malonate, malic acid, fumaric acid, diglycolic acid, thioglycolic acid, ethyliminodipropionic acid, nitrilotriacetic acid, ethylenediamine tetraacetic acid, aminotriacetic acid, ethylenedithioglycolic acid, dithioglycolic acid, etc.

Examples of polyvalent cations include ferric ions, cobaltic ions, and cupric ions. A complex salt of sodium ethylenediamine tetraacetate with iron is quite useful as the bleaching agent.

The bleach-fix solution of the invention can advantageously contain additives used in conventional bleach-fix solutions, such as sodium sulfite, potassium bromide, potassium iodide, sodium iodide, a polyalkylene oxide, 2-mercaptoimidazole, 3-mercapto-1,2,4-triazole, dithioglycol, thiourea, ethylene thiourea, a hydroxylamine salt, o-aminophenol, ascorbic acid, semicarbazide, hydrazine, etc.

These bleaching solutions, bleach-fix solutions and the components contained therein are well known to one skilled in the art as disclosed in, for example, *The Journal of the Society of Motion Picture and Television Engineers*, 61, pp. 665–701, and U.S. Pat. Nos. 3,189,452 and 3,582,322.

An example of bleach-fix bath which can be used in the invention is shown by the following formulation,

| | |
|---|---|
| Bleaching Agent | amount shown below |
| Sodium Carbonate (monohydrate) | 5 g |
| Boric Acid | 5 g |
| Sodium Sulfite | 5 g |
| Fixing Agent | amount shown below |
| Water to make one liter (pH 6.0) | |

The bleaching agent and the fixing agent are shown below.

| Bleach-fix Bath | Bleaching Agent | Fixing Agent |
|---|---|---|
| a) | Ferric Sulfate 0.05 mol<br>Disodium Ethylenediamine Tetraacetic Acid 0.1 mol | Sodium Thiosulfate 0.6 mol |
| b) | Sodium Ethylenediamine Tetraacetic Acid-Iron(III) Complex Salt 0.1 mol | " |
| c) | Nitrilotriacetic Acid-Iron(III) Complex Salt 0.1 mol | " |
| d) | N-Hydroxyethyl-ethylenediamine Triacetic Acid-Iron(III) Complex Salt 0.1 mol | " |
| e) | Sodium Ethylenediamine Tetraacetic Acid-Iron(III) Complex Salt 0.1 mol | Potassium Thiocyanate 0.6 mol |
| f) | Sodium Ethylenediamine Tetraacetic Acid-Iron(III) Complex Salt 0.1 mol | Potassium Thiocyanate 0.5 mol<br>Sodium Thiosulfate 0.5 mol |
| g) | Sodium Ethylenediamine Tetraacetic Acid-Iron(III) Complex Salt 0.1 mol | Thiourea 0.066 mol<br>Sodium Thiosulfate 0.6 mol |

According to the present invention, the color photographic light-sensitive material is exposed and color developed with a color developer, whereby silver images necessary for sound images are formed together with the yellow, magenta and cyan dye images for the color images. Although silver images are formed, in this case, in the color image portions, they are easily removed by the above-described bleach or bleach-fix bath. On the other hand, the silver images formed in the emulsion layers containing the bleach inhibitor are not bleached by the bleach or bleach-fix bath and therefore remain in the layer. Accordingly, according to the invention, sound images (silver images) can be produced using only conventional color development, and the processing steps can be greatly simplified because it is unnecessary to carry out sound development for forming silver images. Namely, silver sound development is not necessary using the light-sensitive material of the invention.

Further, according to the invention, sound track areas of silver images are provided. Therefore, there is the advantage that the decrease of optical density caused by light, heat or humidity is not generated which often results in the sound track areas composed of an organic dye having an absorption in the infra-red region.

In some cases, since a yellow filter layer containing a yellow colloidal silver or an antihalation layer containing a black colloidal silver is provided on the photographic light-sensitive material, which colloidal silver is rehalogenated in the bleaching step and developed in sound development, the photographic material can not be sound developed. On the contrary, according to the invention, since sound development is unnecessary, colloidal silver can be used for the photographic material as the yellow filter layer or antihalation layer.

The invention will be explained in greater detail by reference to the following examples. Unless otherwise indicated, all parts, percents, ratios and the like are by weight.

EXAMPLE 1

On opposite surfaces of a cellulose acetate film base, an antihalation layer containing carbon black and a subbing layer were coated. On the subbing layer, a coating composition containing 100 g of a silver iodobromide emulsion (silver content 0.05 mol, iodide content 1.2 mol%) and 7.5 g of α-(2-methylbenzoyl)-3-α-(2,4-di-tert-amylphenoxy)acetoamide-acetoanilide as a yellow coupler which is dispersed in gelatin together with ethyl acetate and dibutyl phthalate was coated to provide a blue-sensitive emulsion layer. On the emulsion layer, a gelatin intermediate layer was coated and then a coating composition containing 100 g of a spectrally sensitized silver chlorobromide emulsion (silver content 0.06 mol, bromide content 30 mol%) and 11.7 g of 1-hydroxy-4-chloro-N-hexadecyl-N-(2-cyanoethyl)-2-naphthamide as a cyan coupler dispersed in gelatin together with ethyl acetate and dibutyl phthalate was coated to provide a redsensitive emulsion layer. The emulsion layer was spectrally sensitized with 0.0015 g of the following spectral sensitizer so as to have a sensitization maximum at about 685 μ.

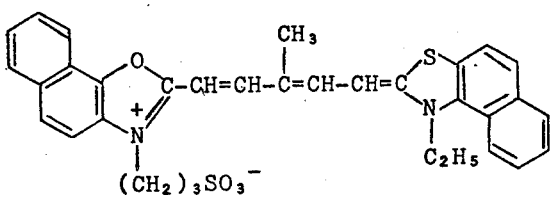

On the red-sensitive emulsion layer, a gelatin intermediate layer was coated and then a coating composition containing 100 g of a silver chlorobromide emulsion (silver content 0.06 mol, bromide content 35 mol%) and 2.1 g of 1-(2,6-dichloro-4-methylphenyl)-3-[3-α-2,4-di-tert-amylphenoxy)butylamide-benzamide]-5-pyrazolone and 4,9 g of 1-(2,4,6-trichlorophenyl)-3-[3-α-(2,4-di-tertamylphenoxy)butylamide-benzamide]-5-pyrazolone as magenta couplers which were dispersed in gelatin together with ethyl acetate and tricresyl phosphate was coated to provide a green-sensitive emulsion layer. The emulsion layer was spectrally sensitized with 0.02 g of the following spectral sensitizer so as to have a sensitization maximum at about 555μ.

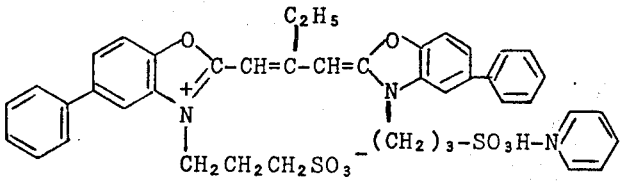

Then, a coating composition composed of liquid paraffin dispersed in an aqueous gelatin solution was coated on the emulsion layer to provide a protective layer. Thus, a color print film as Sample (I) was obtained.

A color print film as Sample (II) was prepared by coating a composition as a sound track area-forming layer containing 100 g of a silver chlorobromide emulsion (silver content 0.06 mol, bromide content 35 mol%), 0.4 g of Bleach Inhibitor (2), 0.1 g of 4-hydroxy-6-methyl-1,3,3a,7-tetraazaindene and the same spectral sensitizer as used for the green-sensitive layer of Sample (I) between the green-sensitive layer and the protective layer as in Sample (I).

A color print film as Sample (III) was prepared in the same manner as in Sample (II) except that Bleach Inhibitor (2) was not added to the sound track area-forming layer. The coating amount of silver in Samples (II) and (III) each was 1.5g/m².

Samples (I), (II) and (III) each was exposed to a tungsten lamp through an ultra violet absorbing filter transmitting light of a wave length longer than about 400 μ, a yellow filter transmitting a light of a wave length longer than about 500 μ and a silver wedge. The filters used in the exposure have been used in the step wedge exposure of usual color print film. Samples (I), (II) and (III) were processed using the following steps A, B and C. The optical densities thus obtained were measured by using a Status S-58 filter using a Macbes TD-206A type densitometer, and are shown in Table 1.

| Processing A<br>Processing Step | Temperature | Time |
|---|---|---|
| Pre-bath | 27°C | 10 seconds |
| Washing | " | 15 sec. |
| Color Development | " | 5 min. 20 sec. |
| Washing | " | 15 sec. |
| First Fixing | " | 1 min. |
| Washing | 27°C | 40 sec. |
| Bleach | " | 3 min. |
| Washing | " | 1 min. |
| Sound Development | 20°C | 15 sec. |
| Washing | 27°C | 15 sec. |
| Second Fixing | " | 2 min. |
| Washing | " | 5 min. |
| Stabilizing | " | 10 sec. |

Each processing composition was as follows.

| | |
|---|---|
| Pre-bath Solution | |
| Water | 800 ml |
| Sodium Carbonate (monohydrate) | 10.0 g |
| Sodium Sulfate (anhydrous) | 50.0 g |
| Water to make one liter | |
| Color Developer | |
| Water | 800 ml |
| Sodium Hexametaphosphate | 2.0 g |
| Sodium Sulfite (anhydrous) | 4.0 g |
| 2-Amino-5-diethylaminotoluene Hydrochloride | 3.0 g |
| Sodium Carbonate (monohydrate) | 25.0 g |
| Potassium Bromide | 2.0 g |

-continued

| | |
|---|---|
| Water to make one liter | |
| First and Second Fixing Solution | |
| Water | 600 ml |
| Sodium Thiosulfate (pentahydrate) | 240 g |
| Sodium Sulfite (anhydrous) | 15.0 g |
| Glacial Acetic Acid | 12.0 g |
| Boric Acid | 6.0 g |
| Potassium Alum | 15.0 g |
| Water to make one liter | |
| Bleaching Solution | |
| Water | 800 ml |
| Potassium Bromide | 20.0 g |
| Potassium Bichromate | 5.0 g |
| Potassium Alum | 40.0 g |
| Sodium Acetate (trihydrate) | 3.0 g |
| Glacial Acetic Acid | 10.1 g |
| Water to make one liter | |
| Sound Developer Solution | |
| (Solution A) | |
| Water | 600 ml |
| Sodium Sulfite (anhydrous) | 40.0 g |
| N-Methyl-p-aminophenol Sulfate | 40.0 g |
| Sodium Hydroxide | 40.0 g |
| Hydroquinone | 40.0 g |
| (Solution B) | |
| Water | 300 ml |
| Tragacanth Gum | 5.0 g |
| Denatured Alcohol | 10 ml |
| (Solution C) | |
| Ethylenediamine (70%) | 20 ml |

Solution A and Solution B were mixed and, immediately before use, Solution C and water were added to make one liter.

| Stabilizing Bath | |
|---|---|
| Water | 800 ml |
| Formalin (37%) | 10 ml |
| Polyethylene Glycol (mol. wt. 400) 40% aqueous Solution | 5 ml |

Processing B

| Processing Step | Temperature | Time |
|---|---|---|
| Pre-bath | 27°C | 10 sec |
| Washing | " | 15 sec |
| Color Development | " | 5 min 20 sec |
| Washing | " | 15 sec |
| First Fixing | " | 1 min |
| Washing | " | 40 sec |
| Bleach | " | 3 min |
| Washing | " | 1 min |
| Second Fixing | " | 2 min |
| Washing | " | 5 min |
| Stabilizing Bath | " | 10 sec |

Each processing solution was same as used in the Processing A.

Processing C

| Processing Step | Temperature | Time |
|---|---|---|
| Pre-bath | 27°C | 10 sec |
| Washing | " | 15 sec |
| Color Development | " | 5 min 20 sec |
| Washing | " | 15 sec |
| First Fixing | " | 1 min |
| Washing | " | 40 sec |
| Bleach | " | 3 min |
| Washing | " | 1 min |
| Second Fixing | " | 2 min |
| Washing | " | 5 min |
| Stabilizing Bath | " | 10 sec |

Each processing solution was same as in Processing A except for the bleaching solution shown below.

| | |
|---|---|
| Ethylenediamine Tetrasodium Tetraacetate-Iron(III) Complex Salt | 100 g |
| Tetrasodium Ethylenediamine Tetraacetate | 18 g |
| Ammonium Bromide | 160 g |
| Aqueous Ammonia Solution | 5 ml |
| Water to make one liter | |

TABLE 1

| Sample | I | | | II | | | III | | |
|---|---|---|---|---|---|---|---|---|---|
| Processing | A | B | C | A | B | C | A | B | C |
| Optical Density in the Infra Red Region | 1.95 | 0.04 | 0.05 | 2.53 | 1.78 | 2.02 | 2.30 | 0.04 | 0.06 |

From the results shown in Table 1, it is apparent that Samples (I) and (III) must be sound-developed in order to obtain an optical density in the infra-red region, and that Sample (II) need only be color developed in a conventional manner in order to obtain it.

EXAMPLE 2

Sample (IV) was prepared by using 0.1 g of the compound disclosed in U.S. Pat. No. 3,715,208 and represented by the formula,

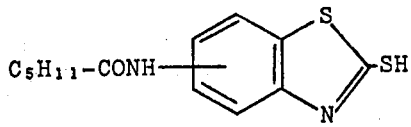

in replace of the Bleach Inhibitor (2) in a sample prepared in the same manner as Sample (II) of Example 1.

The Samples (IV) and (I) to (III) of Example 1 were exposed in the same manner as described in Example 1, and then processed using the following processings D and E. The optical densities thereof in the infra-red region were measured in the same manner as described in Example 1 and are shown in Table 2.

| | Processing D | Processing E |
|---|---|---|
| Processing Temperature | 38°C | 27°C |
| Processing Step | | |
| Pre-bath | 10 sec | 10 sec |
| Washing | 10 sec | 15 sec |
| Color-development | 1 min 30 sec | 5 min 20 sec |
| Stop-fixing | 40 sec | 2 min |
| Washing | 1 min | 2 min |
| Bleach-fixing | 1 min 20 sec | 4 min |
| Washing | 1 min 40 sec | 2 min |
| Stabilizing | 10 sec | 10 sec |
| Stop-fixing Solution | | |
| Sodium Thiosulfate | | 240 g |
| Sodium Sulfite (anhydrous) | | 15 g |
| 28% Acetic Acid | | 48 ml |
| Boric Acid | | 7.5 g |
| Potassium Alum | | 15 g |
| Water to make one liter | | |

-continued

| Bleach-fixing Solution | |
|---|---|
| Ethylenediamine Sodium Tetraacetate-Iron(III) Complex Salt | 34.0 g |
| Sodium Carbonate (monohydrate) | 11.0 g |
| Boric Acid | 45.0 g |
| Sodium Thiosulfate | 140.0 g |
| Water to make one liter | |

The processing solutions other than the stop-fixing solution and the bleach-fixing solution were the same as those used in Processing A.

TABLE 2

| Processing | E | | D | | E |
|---|---|---|---|---|---|
| Sample | I | II | II | III | IV |
| Optical Density in the Infra Red Region | 0.06 | 2.05 | 2.02 | 0.07 | 0.90 |

From the results contained in Table 2, it is apparent that Sample (II) of the invention provided a higher optical density in the infra-red region by the bleach-fixing bath without sound development, while Sample (I) which is a conventional light-sensitive material and Sample (III) which has a sound track area-forming layer but does not contain the bleach inhibitor do not give a practical density in the infra-red region. When the light-sensitive material of the invention is processed at a high temperature as in Processing D gave similar better results, but Sample (IV) having sound track area-forming layer containing the mercapto compound similarly processed did not to provide sufficient optical density. When Sample (II) is processed by Processing B and C, similar better color images and sound images are obtained.

EXAMPLE 3

Sample (V) was prepared using 0.15 g of Bleach Inhibitor (1) instead of Bleach Inhibitor (2) using the same procedures as in Sample (II) of Example 1, and Sample (VI) was prepared using 0.20 g of Bleach Inhibitor (4) instead of Bleach Inhibitor (2) as in Sample (II) of Example 1. Samples (V) and (VI) were exposed, and processed in the same manner as in Examples 1 and 2. The thus obtained optical density in the infra-red region was measured and is shown in Table 3.

TABLE 3

| Sample | V | VI |
|---|---|---|
| Processing | D | D |
| Optical Density in the Infra Red Region | 2.10 | 1.84 |

Using Samples (V) and (VI) which are light-sensitive materials of the invention, a higher optical density in the infra red region is obtained.

While the invention has been described in detail and with reference to specific embodiments thereof, it will be apparent to one skilled in the art that various changes and modifications can be made therein without departing from the spirit and scope thereof.

What is claimed is:

1. A color photographic light-sensitive material comprising a support having coated thereon at least one light-sensitive silver halide emulsion layer containing a yellow dye-forming coupler, at least one light-sensitive silver halide emulsion layer containing a magenta dye-forming coupler, at least one light-sensitive silver halide emulsion layer containing a cyan dye-forming coupler, and at least one light-sensitive silver halide emulsion layer containing a compound represented by the following formula,

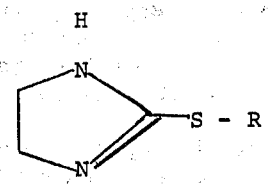

wherein R is an alkyl group having at least 12 carbon atoms.

2. A color photographic light-sensitive material comprising a support having coated thereon at least one blue-sensitive silver halide emulsion layer containing a yellow dye-forming coupler, at least one green-sensitive silver halide emulsion layer containing a magenta dye-forming coupler, at least one red-sensitive emulsion layer containing a cyan dye-forming coupler and at least one silver halide emulsion layer containing a bleach inhibitor represented by the following formula,

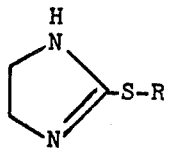

wherein R is an alkyl group having at least 12 carbon atoms.

3. The color photographic light-sensitive material as claimed in claim 2, wherein said silver halide emulsion layer containing said bleach inhibitor contains at least one gelatin hardener selected from the group consisting of an aldehyde, a methylol, a dioxane, an aziridine, an isooxazole, a carbodiimide, an active halogen compound and an active vinyl compound.

4. The color photographic light-sensitive material as claimed in claim 2, wherein said silver halide emulsion layer containing said bleach inhibitor contains at least one spectrally sensitizing cyanine dye or merocyanine dye.

5. The color photographic light-sensitive material as claimed in claim 2, wherein said silver halide emulsion layer containing said bleach inhibitor is adjacent said green-sensitive emulsion layer.

6. The color photographic light-sensitive material as claimed in claim 2, including an intermediate layer adjacent said green-sensitive layer and wherein said silver halide emulsion layer containing said bleach inhibitor is adjacent said intermediate layer.

7. The color photographic light-sensitive material as claimed in claim 2, wherein said silver halide emulsion layer containing said bleach inhibitor is adjacent said blue-sensitive emulsion layer.

8. The color photographic light-sensitive material as claimed in claim 2, including an intermediate layer adjacent said blue-sensitive emulsion layer and wherein said silver halide emulsion layer containing said bleach inhibitor is adjacent said intermediate layer.

9. A process for forming color dye images and silver images which comprises exposing the color photographic light-sensitive material as claimed in claim 2, developing, stopping, first fixing, bleaching and then second fixing said material.

10. The process as claimed in claim 9, wherein said stopping and said first fixing are carried out simultaneously.

11. a process for forming color dye images and silver images which comprises exposing the color photographic light-sensitive material as claimed in claim 2, developing, stopping, bleaching, and fixing said material.

12. A process for forming color dye images and silver images which comprises exposing the color photographic light-sensitive material as claimed in claim 2, developing, bleaching and fixing said material.

13. The color photographic light-sensitive material as claimed in claim 2, wherein said bleach-inhibitor is

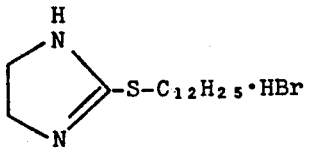

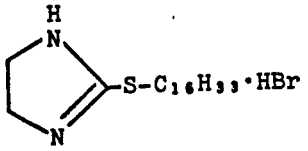

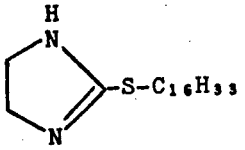

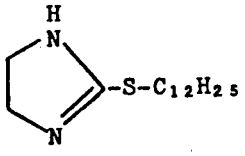

or

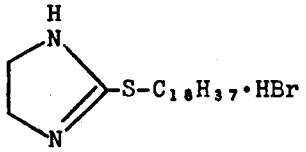

* * * * *